US012421012B2

(12) United States Patent
Jöbges

(10) Patent No.: US 12,421,012 B2
(45) Date of Patent: Sep. 23, 2025

(54) BEVERAGE CONTAINER

(71) Applicant: Ardagh Metal Packaging Europe GmbH, Zug (CH)

(72) Inventor: Udo Jöbges, Düren (DE)

(73) Assignee: Ardagh Metal Packaging Europe GmbH, Zug (CH)

( * ) Notice: Subject to any disclaimer, the term of this patent is extended or adjusted under 35 U.S.C. 154(b) by 0 days.

(21) Appl. No.: 18/246,327

(22) PCT Filed: Sep. 17, 2021

(86) PCT No.: PCT/EP2021/075643
§ 371 (c)(1),
(2) Date: Mar. 22, 2023

(87) PCT Pub. No.: WO2022/063696
PCT Pub. Date: Mar. 31, 2022

(65) Prior Publication Data

US 2023/0365317 A1 Nov. 16, 2023

(30) Foreign Application Priority Data

Sep. 25, 2020 (DE) ..... 10 2020 125 059.2

(51) Int. Cl.
*B65D 81/32* (2006.01)
*B65D 85/72* (2006.01)

(52) U.S. Cl.
CPC ..... *B65D 81/3216* (2013.01); *B65D 85/72* (2013.01)

(58) Field of Classification Search
CPC ..... B65D 81/3216; B65D 85/72
(Continued)

(56) References Cited

U.S. PATENT DOCUMENTS 4,543,148 A * 9/1985 Carlson ..... B65D 77/02 222/137
4,919,295 A * 4/1990 Hitzler ..... B65D 81/3216 D9/518

(Continued)

FOREIGN PATENT DOCUMENTS

DE 102018110764 A1 * 11/2019 ..... B65D 15/18
DE 10 2019 112 818 11/2020

(Continued)

OTHER PUBLICATIONS

International Search Report; PCT/EP2021/075643, dated Jan. 10, 2022, 2 pages.

*Primary Examiner* — Orlando E Aviles
*Assistant Examiner* — Niki M Eloshway
(74) *Attorney, Agent, or Firm* — Knobbe, Martens, Olson & Bear, LLP

(57) ABSTRACT

Beverage container, at least comprising a housing with a base, a lid and a wall region connecting the base with the lid, as well as a first core bevel between the lid and the wall region extending circumferentially along a circumferential direction; wherein the beverage container has a first volume which can be at least partially filled with a liquid; wherein a closure is arranged in the lid and along a radial direction within the first core bevel, via which closure the liquid can be removed from the first volume in the opened state; wherein at least a portion of the opened closure extends into the first volume; wherein a fluid container is arranged within the first volume.

18 Claims, 2 Drawing Sheets

Figure 1:
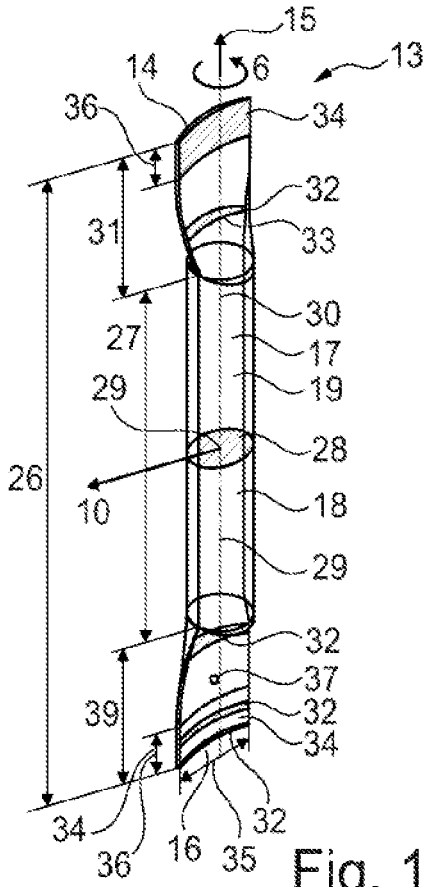

(58) Field of Classification Search
USPC ..... 220/505, 506, 524, 528
See application file for complete search history.

(56) References Cited

U.S. PATENT DOCUMENTS

| | | | | | |
|---|---|---|---|---|---|
| 5,335,813 | A * | 8/1994 | Qi | B65D 81/3216 D9/438 |
| 5,492,244 | A * | 2/1996 | Kim | B65D 25/04 220/524 |
| 5,885,635 | A | 3/1999 | Spring et al. | |
| 5,992,677 | A * | 11/1999 | Ebine | B65D 81/3216 220/524 |
| 8,875,926 | B2 * | 11/2014 | Grajqevci | B65D 17/4014 222/557 |
| 2012/0055818 | A1 * | 3/2012 | Zimmern | B65D 7/04 220/270 |
| 2013/0240535 | A1 * | 9/2013 | Grajqevci | B65D 51/22 220/524 |
| 2013/0292293 | A1 * | 11/2013 | Bernhard | B65D 25/00 220/524 |
| 2020/0223589 | A1 * | 7/2020 | Wondka | B65D 47/06 |

FOREIGN PATENT DOCUMENTS

| | | | | |
|---|---|---|---|---|
| EP | 2 937 296 | | 10/2015 | |
| WO | WO-9721613 | A1 * | 6/1997 | B65D 77/24 |
| WO | WO 2019/211042 | A1 | 11/2019 | |

* cited by examiner

BEVERAGE CONTAINER

CROSS REFERENCE TO RELATED APPLICATIONS

This application is the U.S. National Phase Application under 35 U.S.C. § 371 of International Application No. PCT/EP2021/075643, filed Sep. 17, 2021, which claims priority to German Application No. 10 2020 125 059.2, filed on Sep. 25, 2020, the entire disclosure of each of which is hereby incorporated by reference.

The present invention relates to a beverage container with a fluid container, wherein the beverage container is in particular a (metallic) beverage can. The beverage container serves for storing a content, e.g. a liquid, and for storing the fluid container, wherein the beverage container in the closed state (initial state) is under an overpressure relative to the environment or relative to an atmospheric pressure of approximately 1 bar. The fluid container is provided for arrangement in the beverage container, wherein the fluid container stores a fluid (a fluid other than the content or the liquid of the beverage container) that escapes into the content or the liquid of the beverage container, in particular when the beverage container is opened.

Particularly in the case of beverage cans with carbonated content, the beverage container may be under an internal pressure of up to 6.2 bar before it is opened for the first time.

DE 10 2018 110 764 A1 discloses a beverage container in which a pressure container is arranged. This pressure container is arranged fixed in position in the beverage container via a retaining element or via an adhesive.

From the subsequently published DE 10 2019 112 818.8, a fluid container for a beverage container is known which has a special shaping for arrangement in the core bevels of the beverage container.

It is therefore an object of the invention to at least partially solve the problems existing with reference to the prior art and, in particular, to provide a fluid container (as a pressure container) which can be used for a variety of beverage containers and closures. It should be possible to fix the fluid container with respect to its position.

These objects are solved with a beverage container according to the features of claim 1. Further advantageous embodiments are specified in the dependent claims. It should be noted that the features listed individually in the dependent claims can be combined with one another in a technologically appropriate manner and define further embodiments of the invention. In addition, the features indicated in the claims are further specified and explained in the description, wherein further preferred embodiments of the invention are illustrated.

A beverage container is proposed, at least comprising a housing having a base, a lid, and a wall portion connecting the base to the lid, and a first core bevel extending circumferentially along a circumferential direction between the lid and the wall portion. The beverage container has a first volume that is at least partially fillable or filled with a liquid. A closure is arranged in the lid and along a radial direction within the first core bevel, via which the liquid can be removed from the first volume in the open state; wherein at least a portion of the opened closure extends into the first volume. A fluid container is arranged within the first volume. The fluid container extends from a first end disposed in the first core bevel at least along an axial direction toward the base to a second end of the fluid container and has a second volume within a fluid container wall for storing a fluid. The first end is shaped and arranged such that for each position of the portion of the closure which extends into the first volume during opening and in the opened state, the fluid container is arranged without contact with the portion.

In particular, it is taken into account here that during opening and, if necessary, also during (re)closing of the closure, the fluid container does not collide with the portion extending into the first volume. For this purpose, the fluid container is arranged in particular with its first end in the first core bevel and, with its shaping of the first end takes into account the range of movement of the portion of the closure extending into the first volume.

The first core bevel is in particular a groove in the lid or in the region between the lid and the wall region, wherein the groove in the circumferential direction is formed circumferentially. The groove has a width in the radial direction and a depth in the axial direction. The first volume extends into the groove. At its axial end the groove is limited with respect to the radial direction by an inner wall which extends circumferentially along the circumferential direction and by an outer wall which extends circumferentially along the circumferential direction, in particular parallel to the inner wall.

Beverage containers are regularly cylindrical in shape and therefore rotationally symmetrical about a central axis extending along the axial direction. The position of the fluid container to be arranged in the beverage container cannot be aligned during the manufacture of the beverage container with the closure or lid which is only subsequently attached to the beverage container. Therefore, when arranging and shaping the fluid container, special consideration must be given to ensure that the fluid container cannot collide with the portion of the closure extending into the first volume when opened, even regardless of the position of the closure. The first volume of the beverage container is the volume enclosed by the beverage container and the closed closure.

In particular, the fluid container has a fluid container wall made of a plastic, in particular PP (polypropylene), or of another material. The fluid container wall has a wall thickness of in particular at most one (1) millimeter, preferably at most 0.5 millimeter, particularly preferably at most 0.25 millimeter; in particular at least 0.1 millimeter.

The fluid container extends between the first end and the second end, in particular along a longitudinal axis. Between the ends and/or specially shaped end regions, the fluid container is designed to be in particular rotationally symmetrical in a central region.

In particular, the fluid container has a diameter extending transversely to the longitudinal axis of at most 20 millimeters, preferably at most 15 millimeters, particularly preferably at most 13 millimeters. In particular, the diameter is at least 5 millimeters, preferably at least 10 millimeters.

In particular, the central region comprises at least 25%, preferably at least 50%, more preferably at least 75%, of the second volume.

In particular, the central region extends along the axial direction over at least 25%, preferably over at least 50%, preferably at least 75%, of a container length of the fluid container extending between the first end and the second end along the longitudinal axis.

In particular, the central region has a substantially constant and/or rotationally symmetrical cross-sectional area formed by the fluid container wall and the area enclosed by it in the cross-section. The cross-sectional area has in particular a centroid (an area center of gravity), which is arranged in particular within the cross-sectional area (in the case of a cylindrical design of the central region, the cross-sectional area thus has, for example, a circular shape, the centroid being arranged in the center of the circle).

In particular, the longitudinal axis extends through all centroids of the cross-sectional areas of the central region.

The fluid container is in particular arranged in the beverage container in such a way that the longitudinal axis of the fluid container extends parallel to the axial direction.

In particular, the first end region has a shape that differs from the central region. In particular, the first end region has a shape that is not rotationally symmetrical with respect to the longitudinal axis.

The second volume enclosed by the fluid container can be connected to an environment of the fluid container via at least one or exactly one opening. The second volume is then formed in particular via a fluid container wall which for this purpose is theoretically considered as continuous, that is without opening. The at least one opening has in particular a maximum opening diameter of 0.5 millimeters. The fluid container can also be designed without an opening. The at least one opening is arranged in particular at a second end of the fluid container, for example in a second end region of the fluid container.

In particular, the first end is arranged outside a partial volume of the first volume, the partial volume having a cylindrical shape with a diameter and a length along the axial direction. The partial volume is arranged centered with respect to the radial direction and the first core bevel and extends from the lid along the length. The length and the diameter are each dimensioned such that the portion is always disposed within the partial volume when opened.

Thus, the partial volume refers to the space within the first volume in which the portion of the opened closure can be located. By the fact that the fluid container is formed and arranged in such a way that it is always located outside the (cylindrical) partial volume, it can be ensured that the fluid container remains undam-aged and/or that the closure can also be reclosed.

In particular, the closure is arranged in the lid. The area of the lid within which the closure is arranged is limited, for example, by the first core bevel or by the inner wall of the first core bevel. The first core bevel is thus arranged along the circumferential direction circumferentially around the closure and along the radial direction outside of the closure. The portion of the closure extends into the first volume after opening of the closure. In particular, the radial direction extends outwardly from a central axis of the beverage container and transversely to a circumferential direction and transversely to the axial direction.

In particular, the fluid container, starting from the central region and/or from a second end or a second end region, tapers (shrinks) along the axial direction and towards the first end at least partially increasingly relative to the radial direction.

In particular, the fluid container is arranged in the first volume with a positive fit (form fit) via the first core bevel with respect to the radial direction. In particular, the fluid container is supported by the inner wall and/or the outer wall of the first core bevel with respect to the radial direction.

In particular, a second core bevel arranged opposite the first core bevel and extending circumferentially along the circumferential direction is arranged between the base and the wall region. A height of the first volume, the height extending along the axial direction, extends between the first core bevel and the second core bevel. The fluid container is arranged with the second end in particular in the second core bevel and is arranged in the first volume with a positive fit (form fit) via the core bevels with respect to a radial direction. The explanations regarding the first core bevel apply in particular equally to the second core bevel.

In particular, the fluid container extends between the first end and the second end over a container length, the container length being less than the height by at most 5 millimeters.

In particular, the fluid container has a central region between the first end and the second end, which along the axial direction has a central cross-sectional area extending transverse to the axial direction and which has a longitudinal axis extending parallel to the axial direction and passing through a centroid of the central cross-sectional area. The fluid container has, at least between the first end and the central portion, a first end region; wherein a) at least a portion of the first end region is formed by opposing portions of the fluid container wall contacting each other; and/or b) the first end region along the axial direction having first cross-sectional areas extending transversely to the axial direction and having first centroids, wherein at least a part of said first centroids being arranged in a radial direction spaced from the longitudinal axis.

In particular, the first end region is formed, e.g. starting from a shape corresponding to the shape in the central region, by compressing the fluid container wall substantially transversely to the longitudinal axis, wherein portions of the fluid container wall previously arranged opposite and spaced apart from one another now contact (and abut) one another as a result of the compression and are possibly connected to one another, e.g. in a materially bonded manner.

In particular alternatively or additionally, the first end region has along the axial direction first cross-sectional areas extending transversely to the axial direction, which are formed by the fluid container wall and by the area possibly enclosed by the fluid container wall in the respective first cross-section. These first cross-sectional areas each have first centroids, wherein at least some of the first centroids being arranged at a distance from the longitudinal axis in a radial direction.

In particular, the first centroids, arranged along the longitudinal axis in alignment with the cross-sectional area of the central region, are located within the cross-sectional areas of the central region.

In particular, the first centroids are arranged within a first cross-sectional area associated with the respective first centroid.

In particular, at least a part of the first centroids is arranged outside a first cross-sectional area associated with the respective first centroid. Such an embodiment may be present, for example, if the first cross-sectional area extends in a crescent-like manner.

In particular, the mutually contacting areas (of the fluid container wall) form a connecting region which extends transversely to the longitudinal axis over a width and along the longitudinal axis over a distance. At least a portion of the connecting region has a curved course along the width. In particular, the distance is greater than a wall thickness of the fluid container wall, in particular by a factor of at least two (2), preferably by a factor of at least five (5), particularly preferably by a factor of at least ten (10).

In the connecting region, the fluid container in particular has no second volume enclosed by the fluid container walls.

In particular, the explanations regarding the first end region also apply to a second end region, although both end regions can also be designed differently. The second end region is arranged in particular along the longitudinal axis of the fluid container between the second end and the central region.

In particular, the second end region is designed identically to the first end region, whereby the first end region preferably has no opening.

In particular, at least a part of the connecting region along the width (i.e. along the first cross-sectional area) has a curved (that is not a straight) course.

In particular, the fluid container has at least one opening in the second end region (but outside of the connecting region), possibly also several openings. The at least one opening connects the second volume inside the fluid container via the fluid container wall to an environment outside the fluid container. In particular, the at least one opening (in particular each of the openings) is located outside the connecting region.

In particular, the opening is pierced, i.e. pricked, e.g. with a needle. For example, to form an opening with a diameter of 0.1 millimeter, a needle with a diameter of 0.14 millimeters can be used. The smaller diameter of the opening results from the partial elastic forming of the container material during the piercing process.

In particular, at least partial filling of the fluid container with a fluid takes place in time before the fluid container is completely sealed during the production of the fluid container.

Alternatively, the fluid container may not be filled with a fluid at all (other than ambient air or the surrounding atmosphere), so that filling of the fluid container occurs at a later time and then via the at least one opening.

The fluid can be a gas, a liquid or a solid, e.g. a powder. The fluid can also be composed of several different fluids, e.g. also of powdery and gaseous fluids, powdery and liquid fluids, etc.. In particular, an aggregate state of the fluid within the fluid container may change over time. The fluid is preferably nitrogen.

A (metallic) beverage container is proposed, at least comprising a housing (sealed in an initial state) having a base, a lid, and a (cylindrical) wall portion connecting the base to the lid. The beverage container has a first volume that is partially fillable with a liquid (which has a third volume) (or is filled in the initial state). Within the first volume the described fluid container is arranged.

The beverage container is in particular a beverage can.

In an upright state of the beverage container, the base is arranged on the downside relative to the direction of gravity and the lid is arranged on the upside. In particular, the wall portion between the base and the lid extends along an axial direction (substantially) parallel to the direction of gravity (when the beverage container is standing upright) and in a circumferential direction completely around the base and the lid.

In an initial state, the beverage container is in particular under a first pressure that is greater than a second pressure of an environment (in particular, the second pressure is at most 1.1 bar, preferably the first pressure is at least 2.5 bar). As long as the beverage container is in the initial state, the pressure within the volumes (first volume, second volume, third volume) is in particular equal in each case.

In the initial state, the fluid container is at least partially filled with a fluid (e.g. a gas) (possibly additionally partially filled with the liquid, in particular from the third volume). When the beverage container is opened and the pressure is equalized with the environment, at least the fluid (optionally also the liquid) exits from the second volume, e.g. via the at least one opening, into the liquid and/or into the third volume.

The fluid container and/or the connecting area can in particular be designed in such a way that, when the beverage container is opened and the pressure is equalized with the environment, the fluid container, which is otherwise closed, bursts open, in particular at a point provided for this purpose, so that the fluid can escape from the fluid container into the liquid.

The first volume is in particular between 0.1 and 5 liters, preferably at most 3 liters, particularly preferably at most 1.5 liters.

The third volume is in particular between 1% and 10%, preferably between 1% and 5% less than the first volume.

The second volume is in particular between 1% and 5%, preferably between 1% and 3% of the first volume.

In particular, a sum of the second volume and the third volume is at least 1% smaller than the first volume.

The beverage container is generally opened via an actuable closure in the lid. In particular, the opening of the opened closure in this way cannot be reclosed and/or the overpressure prevailing in the beverage container in the initial state can only be restored to a limited extent by reclosing the opening.

The beverage container extends in particular from the base to the lid along an axial direction. The axial direction preferably runs parallel to the wall portion. In particular, the beverage container is essentially cylindrical and has (apart from structures e.g. in the lid, e.g. for opening/closing the first volume) an axis of rotation or an axis symmetry which extends parallel to the axial direction.

In particular, the beverage container comprises at least one second core bevel extending circumferentially along a circumferential direction between the base and the wall portion and/or or in the base, and a first core bevel, arranged opposite the second core bevel, extending circumferentially along a circumferential direction between the lid and the wall portion and/or in the lid. A (possibly largest) height of the first volume extends between the first core bevel and the second core bevel (along the axial direction, in particular parallel to the axial direction).

In particular, the fluid container is arranged with the first end in the first core bevel and with the second end in the second core bevel and is arranged in a form-fitting (positive fit) manner in the first volume via the core bevels with respect to a radial direction. In particular, the fluid container is thus also arranged in a form-fitting (positive fit) manner in the beverage container with respect to the axial direction, if necessary with a play of about 0 to at most 5 millimeters.

In particular, the fluid container extends between the first end and the second end over a container length, the container length being less than the height between the core bevels by at most 5 millimeters.

The particular embodiment of at least the fluid container enables a permanently positionally fixed arrangement of the fluid container in the beverage container.

In particular, for example, an additional retaining element or an adhesive can be dispensed with. If necessary, an adhesive is used to arrange the fluid container at least temporarily in the beverage container, e.g. on the wall portion.

In particular, fixing the fluid container in the core bevels enables that at least temporary softening of an adhesive (e.g., in the course of pasteurization of the fluid stored in the beverage container) does not to lead to displacement of the fluid container in the beverage container.

Thus, in particular, a beverage container may comprise the wall portion and one of a base and a lid and as such a housing may be filled with a fluid, wherein the fluid container may already be arranged in the beverage container (and possibly fixed in the beverage container, e.g., via an adhesive). After arrangement of the fluid container, the missing one of the base and the lid can be provided for closing the beverage container, whereby, if necessary, the fluid is provided before closing.

In particular, the first volume has between the base and the lid along an axial direction the (greatest) height (in particular between the core bevels), wherein the fluid container has between the first end and the second end a container length along the axial direction which is at least 85% of the (greatest) height. Particularly preferably, the container length is at least 90% or even at least 95% of the (greatest) height, more preferably at least 99.5% of the (greatest) height.

In particular, for an upright beverage container, the second volume of the fluid container extends into an upper region adjacent to the lid, the upper region being above a predetermined level of the fluid.

In particular, the first volume in an upright beverage container has at least one lowest point (in the second core bevel). The second end of the fluid container extends into the second core bevel and to, or at least near, the lowest point. The second volume of the fluid container filled or fillable with a fluid extends into a lower region adjacent to the base, in particular such that the at least one opening is arranged at a distance of at most 20 millimeters, in particular at most 10 millimeters, preferably at most 6 millimeters, particularly preferably at most 4 millimeters from the lowest point.

The fluid container proposed herein, extending along the axial direction and the height, can also be arranged off-center with respect to the base and/or the first volume due to its smaller extension in a radial direction. Thus, the fluid container can in particular be arranged (directly) adjacent to the wall area and extend into the core bevels of the beverage container (the deepest edge of the beverage container, which regularly extends around the curved base). The particular embodiment of the ends or end regions of the fluid container allows it to be disposed within almost any beverage container, so that a collision between the fluid container and the portion of the closure extending into the first volume when the closure is opened can be avoided.

As a result of the arrangement of the at least one opening at the small distance from the lowest point, a larger partial volume of the third volume can be excited by the outflow of at least the fluid from the fluid container.

In particular, the fluid container extends into both core bevels of the beverage container so that it is fixed in its position (i.e., extending into both core bevels) via the core bevels at least with respect to a radial direction.

In particular, the fluid container can be (in particular exclusively) elastically deformed at least at one end, preferably at both ends, by the beverage container (preferably by the core bevel or by both core bevels), so that the pressure container is fixed in its position in the core bevels and in the first volume also relative to a circumferential direction.

In particular, the fluid container is arranged at least with the first end or with the second end (directly) adjacent to a wall (e.g. the base, the lid or the wall area) of the beverage container, so that a stop is formed between the end and the wall at least with respect to an axial direction. In particular, the fluid container is arranged with respect to the wall in such a way that a further displacement of the pressure container along the axial direction forces at least a displacement of the end of the fluid container contacting the wall in the radial direction or in the circumferential direction. Adjacent in this context means in particular that the end is arranged at a distance of at most 2 millimeters from the wall. Immediately adjacent then means that the end contacts the wall.

In particular, at least one end of the fluid container has a curved course in the region of a connecting region, which is designed to match the course of the corresponding core bevel along the circumferential direction.

In particular, both ends are arranged (directly) adjacent to a respective wall, so that further movement of the fluid container along the axial direction is at least restricted.

In particular, at least one end of the fluid container extends over a width so that tilting of the longitudinal axis relative to the axial direction is prevented via contact of the end with the base or lid.

In particular, this can prevent loosening of the fluid container and the development of noise due to movement of the fluid container relative to the beverage container.

Alternatively, the fluid container can be connected to a wall (in particular to the wall portion) of the beverage container by using an adhesive, whereby the pressure container is additionally, e.g. as a result of extending into the core bevels of the beverage container, fixed in its position at least with respect to a radial direction or is even frictionally fixed in its position (e.g. as a result of at least elastic deformation or by a retaining element).

The filling of the beverage container and the fluid container can be carried out in a known manner, for example, as follows:

- providing a housing comprising base and wall portion, without lid;
- providing the fluid container (e.g. with opening, possibly already filled with fluid or without fluid);
- placing the fluid container in the housing; if necessary by using an adhesive;
- filling the housing with the fluid (third volume);
- if necessary, filling the housing (starting from third volume, in particular up to at most the first volume) with fluid, e.g. with inert gas (if necessary at least partially liquefied);
- (gas-tight) closing of the housing with the lid and forming the beverage container;
- if necessary, turning the beverage container upside down so that the base faces upwards (relative to the direction of gravity) and so that the at least one opening, if present, is arranged above the filling level of the first volume with the liquid, i.e. above the third volume.
- If necessary, filling the fluid container via the opening with the fluid, e.g. with the inert gas, that expands by heating in the closed beverage container, and/or by changing the aggregate state of the inert gas and the resulting expansion of the inert gas.

Providing the beverage container in an initial state.

The explanations regarding the fluid container apply equally to the beverage container and the process and vice versa.

As a precaution, it should be noted that the number words used here ("first", "second", "third", . . . ) primarily serve (only) to distinguish between several similar objects, variables or processes, i.e., in particular, they do not necessarily specify any dependence and/or sequence of these objects, variables or processes with respect to one another. Should a dependency and/or sequence be required, this is explicitly indicated here or it is obvious to the person skilled in the art when studying the concretely described embodiment.

Figure 2:
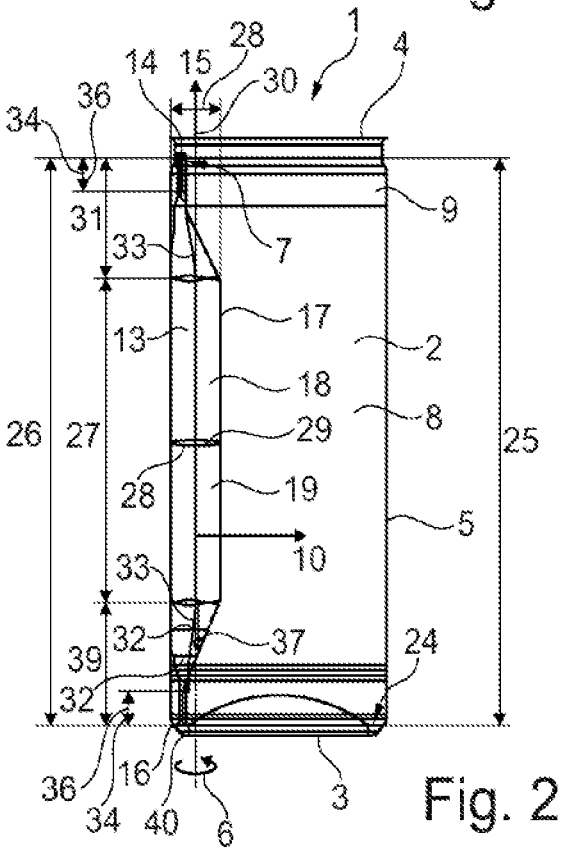
Figure 3:
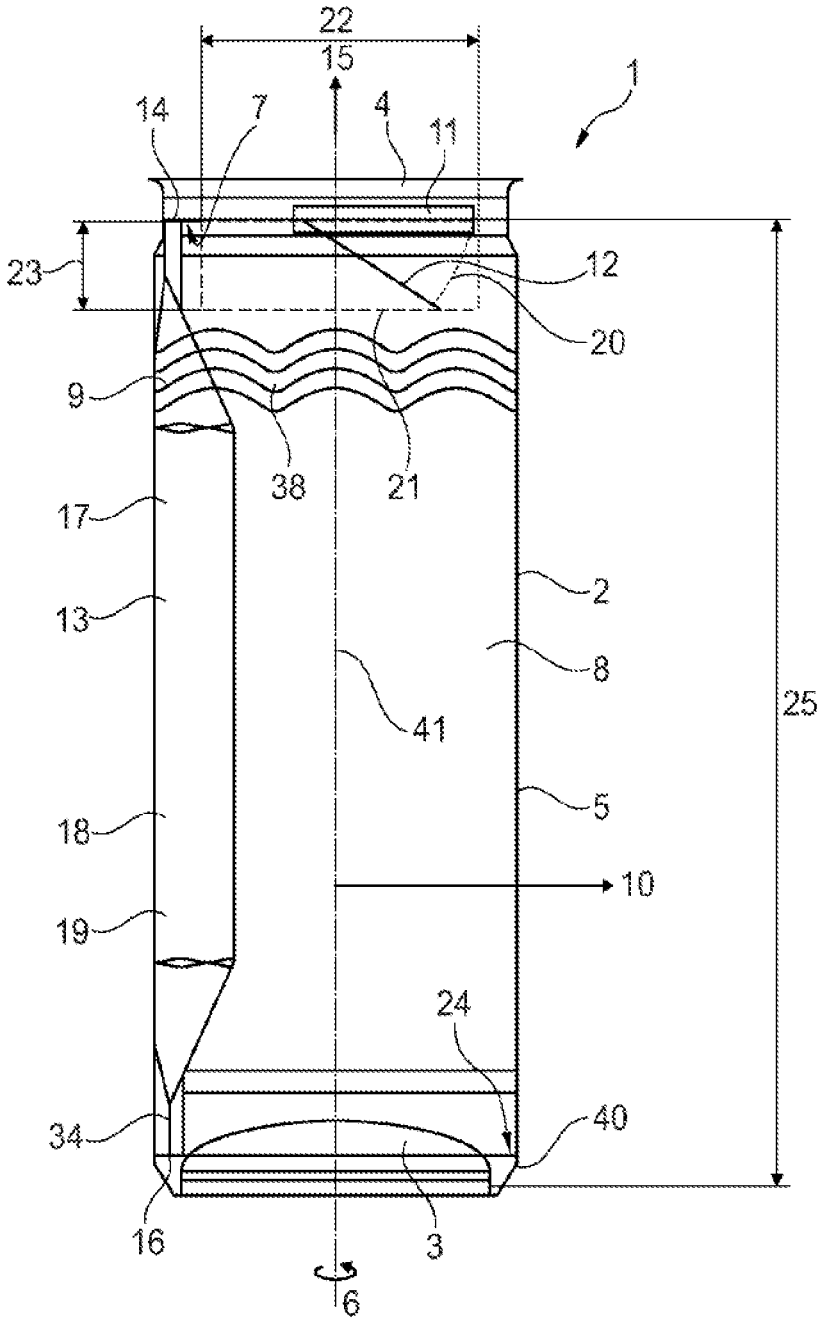

The invention as well as the technical environment will be explained in more detail below with reference to the figures. It should be noted that the invention is not intended to be limited by the embodiment variants shown. In particular, unless explicitly shown otherwise, it is also possible to extract partial aspects of the facts explained in the figures and to combine them with other components and findings from the present description and/or figures. Identical reference signs designate identical objects, so that explanations from other figures can be used as a supplement if necessary. It shows schematically:

FIG. 1: a fluid container in a perspective view;

FIG. 2: a beverage container with fluid container arranged therein according to FIG. 1, in a perspective partially transparent side view; and FIG. 3: the beverage container according to FIG. 2 with closure, in a partially transparent side view.

FIG. 1 shows a fluid container 13 in a perspective view. FIG. 2 shows a beverage container 1 with fluid container 13 arranged therein according to FIG. 1, in a perspective partially transparent side view. FIG. 3 shows the beverage container 1 according to FIG. 2 with closure 11, in a partially transparent side view. FIGS. 1 to 3 are described together below.

The beverage container 1 has a first volume 8, which can be partially filled with a third volume 38 of a liquid 9. A fluid container 13 is arranged within the first volume 8. The beverage container 1 is a beverage can.

The beverage container 1 comprises a housing 2 with a base 3, a lid 4 and a wall portion 5 connecting the base 3 to the lid 4, as well as a first core bevel 7 extending circumferentially along a circumferential direction 6 between the lid 4 and the wall portion 5. The beverage container 1 has a first volume 8 which is at least partially fillable or filled with a liquid 9. A closure 11 is arranged in the lid 4 and along a radial direction 10 within the first core bevel 7, via which the liquid 9 can be removed from the first volume 8 in the open state; wherein at least a portion 12 of the opened closure 11 extends into the first volume 8. The radial direction extends in particular from a central axis 41 (see in FIG. 3) of the beverage container 1 outwardly and thereby transversely to a circumferential direction 6 and transversely to the axial direction 15. A fluid container 13 is arranged within the first volume 8. The fluid container 13 extends from a first end 14 arranged in the first core bevel 7 at least along an axial direction 15 towards the base 3 to a second end 16 of the fluid container 13 and has within a fluid container wall 17 a second volume 18 for storing a fluid 19. The first end 14 is shaped and arranged such that, for each position 20 of the portion 12 of the closure 11 extending into the first volume 8 when opened and in the opened state, the fluid container 13 is arranged without contact with the portion 12.

The fluid container 13 extends between the first end 14 and the second end 16 along a longitudinal axis 30 (see FIG. 2). Between the ends 14, 16 and/or between separately formed end regions 31, 39, the fluid container 13 is designed to be rotationally symmetrical in a central region 27 in particular.

The central region 27 has a substantially constant and rotationally symmetrical cross-sectional area 28, which is formed by the fluid container wall 17 and the area enclosed by it in the cross-section. The cross-sectional area 28 has in particular a centroid 29, which is arranged in particular within the cross-sectional area 28 (thus, in the case of a cylindrical configuration of the central region 27, the cross-sectional area 28 has, for example, a circular shape, with the centroid 29 being arranged in the center of the circle).

The longitudinal axis 30 extends through all centroids 29 of the cross-sectional areas 28 of the central region 27. The longitudinal axis 30 extends in particular parallel to the axial direction 15.

The first end region 31 has a shape that differs from the central region 27. The first end region 31 has a shape that is not rotationally symmetrical with respect to the longitudinal axis 30.

The second volume 18 enclosed by the fluid container 13 is connected to an environment of the fluid container 13 via an opening 37. The opening 37 is disposed at a second end 16 of the fluid container 13 in a second end region 39 of the fluid container 13.

The first end 14 is arranged outside a partial volume 21 of the first volume 8, the partial volume 21 having a cylindrical shape with a diameter 22 and a length 23 along the axial direction 15. The partial volume 21 is arranged centered with respect to the radial direction 10 and the first core bevel 7, and extends from the lid 4 over the length 23. The length 23 and the diameter 22 are each dimensioned such that the portion 12 is always arranged within the partial volume 21 when opened.

The fluid container 13 tapers (shrinks) increasingly from the central region 27 along the axial direction 15 and towards the first end 14 with respect to the radial direction 10.

The fluid container 13 is positively arranged in the first volume 8 via the first core bevel 7 with respect to the radial direction 10.

A second core bevel 24 arranged opposite the first core bevel 7 and extending circumferentially along the circumferential direction 6 is arranged between the base 3 and the wall region 5. A height 25 of the first volume 7 extending along the axial direction 15 extends between the first core bevel 7 and the second core bevel 24. The fluid container 13 is arranged with the second end 16 in the second core bevel 24 and is arranged with a form-fit in the first volume 8 via the core bevels 7, 24 with respect to a radial direction 10.

The fluid container 13 has, between the first end 14 and the second end 16, a central region 27 which has, along the axial direction 15, a central cross-sectional area 28 extending transversely to the axial direction 15 and a longitudinal axis 30 extending parallel to the axial direction 15 and passing through a centroid 29 of the central cross-sectional area 28. The fluid container 13 has a first end region 31 between the first end 14 and the central region 27, at least a portion of the first end region 31 being formed by opposing portions of the fluid container wall 17 that are contacting each other. The first end region 31 has along the axial direction 15 first cross-sectional areas 32 extending transversely to the axial direction and having first centroids 33, at least a portion of the first centroids 33 being spaced from the longitudinal axis 30 in a radial direction 10.

The first end region 31, starting from a shape corresponding to the cylindrical shape in the central region 27, is formed by compressing the fluid container wall 17 substantially transversely to the longitudinal axis 30, regions of the fluid container wall 17 previously arranged opposite and spaced apart from one another now contacting (and abutting) one another as a result of the compression and, if appropriate, being connected to one another, for example in a materially bonded manner.

The first centroids 33, arranged along the longitudinal axis 30 in alignment with the cross-sectional area 28 of the central area 27, are located within the cross-sectional areas 28 of the central area 27. The first centroids 33 are arranged within a first cross-sectional area 32 associated with the respective first centroids 33. A portion of the first centroids 33 are arranged outside a first cross-sectional area 32 associated with the respective first centroid 33. Such an embodiment may be present, for example, if the first cross-sectional area 32 extends in a crescent-like manner, in this case in the region of the ends.

In the respective end region 31, 39, the mutually contacting regions of the fluid container wall 17 form a connecting region 34 which extends transversely to the longitudinal axis 30 over a width 35 and along the longitudinal axis 30 over a distance 36. At least a part of the connecting region 34 has a curved course along the width 35. The distance 36 is significantly greater than a wall thickness of the fluid container wall 17. In the connecting region 34, the fluid container 13 does not have a second volume 18 enclosed by the fluid container walls 17.

The first volume 8 has between the base 3 and the lid 4 along an axial direction the greatest height 25 between the core bevels 7, 24, wherein the fluid container 13 having between the first end 14 and the second end 16 a container length 26 along the axial direction 15 which is here between 95% and 99.5% of the greatest height 25.

The second volume 18 of the fluid container 13 extends, in the case of an upright beverage container 1 (see FIG. 3), into an upper region adjacent to the lid 4, the upper region being above a predetermined filling level of the fluid 9.

The first volume 8 has a lowest point 40 in the second core bevel 24 in an upright standing beverage container 1. The second end 16 of the fluid container 13 extends into the second core bevel 24 and to the lowest point 40. The second volume 18 of the fluid container 13, which is filled or fillable with a fluid 19, extends to a lower region adjacent the base 3, so that the opening 37 is arranged at most millimeters from the lowest point 40.

The fluid container 13 extending along the axial direction 15 and the height 25 can be arranged off-center to the base 3 or first volume 8 due to its smaller extension in a radial direction 10. Thus, the fluid container 13 can be arranged immediately adjacent to the wall region 5 and extend into the core slopes 7, 24 of the beverage container 13. The particular design of the ends 14, 16 or end regions 31, 39 of the fluid container 13 allows it to be arranged within beverage containers 1 of almost any design, so that a collision between the fluid container 13 and the portion 12 of the closure 11 extending into the first volume 8 when the closure 11 is opened can be avoided.

The fluid container 13 extends into both core bevels 7, 24 of the beverage container 1 so that it is fixed in its position (i.e. extending into both core bevels 7, 24) via the core bevels 7, 24 at least with respect to a radial direction 10.

The fluid container 13 is arranged with the first end 14 and with the second end 16 immediately adjacent to a wall (to the base 3 and to the lid 4, but also to the wall region 5) of the beverage container 1, so that a stop is formed between the ends 14, 16 and the wall at least with respect to an axial direction 15. The fluid container 13 is arranged with respect to the wall in such a way that a further displacement of the pressure container 13 along the axial direction 15 forces at least a displacement of the end 14, 16 of the fluid container 13 contacting the wall in the radial direction 10 or in the circumferential direction 6 (i.e. a tilting of the fluid container 13 with respect to the axial direction 15. Both ends 14, 16 of the fluid container 13 have a curved course in the region of a connecting region 34, which is designed to match the course of the corresponding core bevels 7, 24 along the circumferential direction 6. Thus, both ends 14, 16 are also arranged directly adjacent to one wall each, so that a further movement of the fluid container 13 along the axial direction 15 but also along the radial direction 10 as well as the circumferential direction 6 is not possible.

The ends 14, 16 of the fluid container 13 extend over a width 35, so that tilting of the longitudinal axis 30 relative to the axial direction 15 is prevented via contact of the ends 14, 16 with the base 3 and the lid 4.

REFERENCE NUMERALS

1 Beverage container
2 Housing
3 Base
4 Lid
Wall portion
6 circumferential direction
7 first core bevel
8 first volume
9 liquid
radial direction
11 closure
12 portion
13 fluid container
14 first end
15 axial direction
16 second end
17 fluid container wall
18 second volume
19 fluid
20 position
21 partial volume
22 diameter
23 length
24 second core bevel
25 height
26 container length
27 center region
28 cross-sectional area
29 centroid (center of area)
30 longitudinal axis
31 first end region
32 first cross-sectional area
33 first centroid (of area)
34 connecting region
35 width
36 distance
37 opening
38 third volume
39 second end region
40 lowest point
41 central axis

The invention claimed is:

1. A beverage container, comprising:

a housing with a base, a lid and a wall region connecting the base to the lid;

a first core bevel extending circumferentially along a circumferential direction, the first core bevel positioned between the lid and the wall region;

wherein the beverage container includes a first volume which can be filled at least partially with a liquid;

wherein in the lid and along a radial direction within the first core bevel a closure is arranged, via which, in an opened state, the liquid can be removed from the first volume;

wherein, in the opened state, at least a portion of the closure extends into the first volume; and a fluid container including a fluid container wall with a first end and a second end to form a second volume for storing a fluid, the fluid container arranged within the housing and the first volume by the first end being positioned in the first core bevel, wherein the fluid container does not extend into the lid;

wherein the fluid container extends at least along an axial direction towards the base to the second end of the fluid container;

wherein the first end is shaped and arranged such that for each position of the portion of the closure which extends into the first volume is arranged without contact with the portion;

wherein the first end is arranged outside a partial volume of the first volume;

wherein the partial volume includes a cylindrical shape with a diameter and a length along the axial direction;

wherein the partial volume is arranged centered with respect to the radial direction and the first core bevel and extends from the base over the length; and wherein the length and the diameter are each dimensioned such that the portion is always arranged within the partial volume when opened.

2. The beverage container of claim 1, wherein the fluid container, at least in part, increasingly tapers along the axial direction and towards the first end relative to the radial direction.

3. The beverage container of claim 1, wherein the fluid container is arranged with a positive fit in the first volume via the first core bevel relative to the radial direction.

4. The beverage container of claim 1, wherein a second core bevel arranged opposite the first core bevel and extending circumferentially along the circumferential direction is arranged between the base and the wall region; and wherein a height of the first volume extending along the axial direction extends between the first core bevel and the second core bevel and the fluid container is arranged with the second end in the second core bevel and is arranged with a positive fit in the first volume via the first and second core bevels with respect to a radial direction.

5. The beverage container of claim 4, wherein the fluid container extends between the first end and the second end over a container length, wherein the container length is less than the height by at most 5 millimeters.

6. The beverage container of claim 1, wherein the fluid container between the first end and the second end includes a central region which along the axial direction includes a cross-sectional area extending transversely to the axial direction and a longitudinal axis extending parallel to the axial direction and passing through a centroid of the central cross-sectional area;

wherein the fluid container includes a first end region at least between the first end and the central region;

wherein at least portion of the first end region is formed by opposing portions of the fluid container wall contacting each other and/or said first end region including along said axial direction first cross-sectional areas extending transversely to said axial direction and including first centroids, at least a part of said first centroids being arranged in a radial direction spaced from said longitudinal axis.

7. The beverage container of claim 6, wherein at least a part of the first centroids of the fluid container is arranged outside a first cross-sectional area associated with the respective first centroid.

8. The beverage container of claim 6:

wherein the opposing portions of the fluid container wall contacting each other form a connecting area which extends transversely to the longitudinal axis over a width and along the longitudinal axis over a distance; and wherein at least a part of the connecting area along the width includes a curved course.

9. A beverage container, comprising:

a housing with a base, a lid and a wall region connecting the base to the lid;

a first core bevel extending circumferentially along a circumferential direction between the lid and the wall region;

wherein the beverage container includes a first volume which can be filled at least partially with a liquid;

wherein in the lid and along a radial direction within the first core bevel a closure is arranged, via which, in an opened state, the liquid can be removed from the first volume;

wherein, in the opened state, at least a portion of the closure extends into the first volume;

a fluid container arranged within the first volume;

wherein the fluid container, starting from a first end which is arranged in the first core bevel, extends at least along an axial direction towards the base to a second end of the fluid container and includes, within a fluid container wall, a second volume for storing a fluid; and a second core bevel arranged opposite the first core bevel and extending circumferentially along the circumferential direction, the second core bevel being arranged between the base and the wall region;

wherein a height of the first volume extending along the axial direction extends between the first core bevel and the second core bevel and the fluid container is arranged with the second end in the second core bevel and is arranged with a positive fit in the first volume via the first and second core bevels with respect to the radial direction; and wherein the first end is shaped and arranged such that for each position of the portion of the closure which extends into the first volume is arranged without contact with the portion.

10. The beverage container of claim 9, wherein the fluid container extends between the first end and the second end over a container length, wherein the container length is less than the height by at most 5 millimeters.

11. A beverage container, comprising:

a housing with a base, a lid and a wall region connecting the base to the lid;

a first core bevel extending circumferentially along a circumferential direction, the first core bevel positioned between the lid and the wall region;

wherein the beverage container includes a first volume which can be filled at least partially with a liquid;

wherein in the lid and along a radial direction within the first core bevel a closure is arranged, via which, in an opened state, the liquid can be removed from the first volume;

wherein, in the opened state, at least a portion of the closure extends into the first volume; and a fluid container including a fluid container wall with a first end and a second end to form a second volume for storing a second fluid, the fluid container arranged within the housing and the first volume by the first end being positioned in the first core bevel, wherein the fluid container does not extend into the lid;

wherein the fluid container extends at least along an axial direction towards the base to the second end of the fluid container;

wherein the first end is shaped and arranged such that for each position of the portion of the closure which extends into the first volume is arranged without contact with the portion;

wherein the fluid container is pressurized with the second fluid when in a closed state; and wherein, when the beverage container is in the opened state and pressure of the fluid container is released, the second fluid exits from the second volume into the first volume.

12. The beverage container of claim 11, wherein the fluid container, at least in part, increasingly tapers along the axial direction and towards the first end relative to the radial direction.

13. The beverage container of claim 11, wherein the fluid container is arranged with a positive fit in the first volume via the first core bevel relative to the radial direction.

14. The beverage container of claim 11, wherein a second core bevel arranged opposite the first core bevel and extending circumferentially along the circumferential direction is arranged between the base and the wall region; and wherein a height of the first volume extending along the axial direction extends between the first core bevel and the second core bevel and the fluid container is arranged with the second end in the second core bevel and is arranged with a positive fit in the first volume via the first and second core bevels with respect to a radial direction.

15. The beverage container of claim 14, wherein the fluid container extends between the first end and the second end over a container length, wherein the container length is less than the height by at most 5 millimeters.

16. The beverage container of claim 11, wherein the fluid container between the first end and the second end includes a central region which along the axial direction includes a cross-sectional area extending transversely to the axial direction and a longitudinal axis extending parallel to the axial direction and passing through a centroid of the central cross-sectional area;

wherein the fluid container includes a first end region at least between the first end and the central region;

wherein at least a portion of the first end region is formed by opposing portions of the fluid container wall contacting each other and/or said first end region including along said axial direction first cross-sectional areas extending transversely to said axial direction and including first centroids, at least a part of said first centroids being arranged in a radial direction spaced from said longitudinal axis.

17. The beverage container of claim 16, wherein at least a part of the first centroids of the fluid container is arranged outside a first cross-sectional area associated with the respective first centroid.

18. The beverage container of claim 16:

wherein the opposing portions of the fluid container wall contacting each other form a connecting area which extends transversely to the longitudinal axis over a width and along the longitudinal axis over a distance; and wherein at least a part of the connecting area along the width includes a curved course.

* * * * *